US009676018B2

(12) United States Patent
Ding

(10) Patent No.: US 9,676,018 B2
(45) Date of Patent: Jun. 13, 2017

(54) METHOD AND APPARATUS FOR FORMING THE PROFILE OF DEFORMABLE MATERIALS AND DEFORMABLE TUBULAR SECTIONS

(75) Inventor: Shichao Ding, Carlton (AU)

(73) Assignee: The University of Queensland, Queensland, St Lucia (AU)

( * ) Notice: Subject to any disclaimer, the term of this patent is extended or adjusted under 35 U.S.C. 154(b) by 356 days.

(21) Appl. No.: 13/805,084

(22) PCT Filed: Jun. 20, 2011

(86) PCT No.: PCT/AU2011/000744

§ 371 (c)(1),
(2), (4) Date: Mar. 28, 2013

(87) PCT Pub. No.: WO2011/156873

PCT Pub. Date: Dec. 22, 2011

(65) Prior Publication Data

US 2013/0174630 A1 Jul. 11, 2013

(30) Foreign Application Priority Data

Jun. 18, 2010 (AU) ..... 2010902659

(51) Int. Cl.
*B21D 5/10* (2006.01)
*B21D 5/12* (2006.01)
(Continued)

(52) U.S. Cl.
CPC ..... *B21D 5/10* (2013.01); *B21C 37/155* (2013.01); *B21D 5/12* (2013.01); *B21D 7/08* (2013.01);
(Continued)

(58) Field of Classification Search
CPC . B21D 5/12; B21D 7/08; B21D 22/08; B21D 13/02; B21D 13/08; B21D 37/02; B21C 37/15; B30B 5/06
(Continued)

(56) References Cited

U.S. PATENT DOCUMENTS 2,569,266 A * 9/1951 Thompson ..... 72/166
2,642,280 A * 6/1953 Fisk ..... 226/172
(Continued)

FOREIGN PATENT DOCUMENTS

AU WO 2008144832 A1 * 12/2008 ..... B21D 5/06
WO WO 2009/110372 9/2009

OTHER PUBLICATIONS

International Search Report from PCT/AU2011/000744, dated Aug. 11, 2011.

*Primary Examiner* — Jimmy T Nguyen
*Assistant Examiner* — Gregory Swiatocha
(74) *Attorney, Agent, or Firm* — Swanson & Bratschun, L.L.C.

(57) ABSTRACT

An apparatus for forming the profile of deformable materials including tubular sections. The apparatus (1) includes at least two sets (4, 5) of die elements (6), each set (4,5) including a plurality of die elements (6) respectively arranged to travel along corresponding endless path. The paths each include a forming portion (9,10) in which die elements (6) of each set (4. 5) are opposed to define a forming space (11) therebetween. The forming portion (9, 10) of each path is configured so that one or more dimensions of the forming space (11) reduce along the length of the forming portion (9,10) to simultaneously apply lateral forces to material progressing through the forming portion.

18 Claims, 9 Drawing Sheets

(51) Int. Cl.

| | |
|---|---|
| ***B21D 7/08*** | (2006.01) |
| ***B21D 13/08*** | (2006.01) |
| ***B21D 22/08*** | (2006.01) |
| ***B21D 37/02*** | (2006.01) |
| ***B21C 37/15*** | (2006.01) |

(52) U.S. Cl.
CPC ..... *B21D 13/08* (2013.01); *B21D 22/08* (2013.01); *B21D 37/02* (2013.01)

(58) Field of Classification Search
USPC ..... 72/127, 343
See application file for complete search history.

(56) References Cited

U.S. PATENT DOCUMENTS

| | | | | | |
|---|---|---|---|---|---|
| 3,059,319 | A * | 10/1962 | Hart | B21C 37/14 | 228/157 |
| 3,552,164 | A * | 1/1971 | Properzi | 72/45 | |
| 3,568,245 | A * | 3/1971 | Jetzer | B30B 5/06 | 425/115 |
| 4,000,636 | A * | 1/1977 | Shubin et al. | 72/173 | |
| 4,429,559 | A * | 2/1984 | dePuglia | B21D 43/028 | 29/563 |
| 4,917,540 | A * | 4/1990 | Recalde | 405/168.3 | |
| 2009/0255312 | A1* | 10/2009 | Stapleton | 72/214 | |
| 2011/0023571 | A1* | 2/2011 | Wang et al. | 72/127 | |

* cited by examiner

METHOD AND APPARATUS FOR FORMING THE PROFILE OF DEFORMABLE MATERIALS AND DEFORMABLE TUBULAR SECTIONS

RELATED APPLICATIONS

This application is a 35 U.S.C. §371 national phase application of PCT/AU2011/000744 (WO 2011/156873), filed on Jun. 20, 2011, entitled "Method and Apparatus for Forming the Profile of Deformable Materials and Deformable Tubular Sections", which application claims the priority from Australian Application No. 2010902659, filed Jun. 18, 2010, which is incorporated herein by reference in its entirety.

FIELD OF THE INVENTION

This invention relates to the forming of deformable sheet materials from its original profile to a desired profile. One application of the invention is to the forming of sheet metal into a desired profile and the invention will be described in detail in relation to that application however it will be apparent that it is more generally applicable to deformable materials.

BACKGROUND OF THE INVENTION

Known systems for forming deformable materials such as sheet metal into a desired profile include roll forming processes. These involve passing the sheets through a sequence of roll sets each farther deforming the sheet beyond the profile achieved at the previous roll set. The disadvantages of roll forming include redundant deformation resulting from non-uniform strain paths as the strip passes each roll set. That leads to high residual stresses which result in product defects such as edge wave, flare, twist, etc. Another disadvantage of roll forming is that the distance between the first roll set and the last roll set is relatively large. Consequently the space needed to house a roll forming assembly is substantial particularly when forming complex profiles. Known systems using multiple roll sets also suffer from significant difficulties associated with initial alignment. A further disadvantage of roll forming is that tooling design is related to the designer's experience. "Trial and error" plays a dominate role in tooling design and alignment and for a new complex profile tooling design, this means the development time is unpredictable. Additionally a large amount of material can be wasted during the period of tooling design and alignment, which contributes to the cost of tooling development.

SUMMARY OF THE INVENTION

The present invention seeks to provide a method and apparatus of forming a profile of a deformable sheet material which provides an alternative for overcoming some of the disadvantages of the prior art.

Accordingly, in one aspect the present invention provides an apparatus for forming the profile of deformable materials, said apparatus including:

- at least two sets of die elements, each set including a plurality of die elements respectively arranged to travel along corresponding endless paths;
- said paths each including a forming portion in which die elements of each set are opposed to define a forming space therebetween;

- the forming portion of each path being configured so that one or more dimensions of the forming space reduce along the length of the forming portion to simultaneously apply lateral forces to material progressing through the forming portion to shape said material to a determined profile.

In a second aspect the present invention provides an apparatus for forming the profile of deformable materials, said apparatus including:

- at least one set of die elements including a plurality of die elements arranged to travel along an endless path;
- a moving forming surface arranged to travel about a corresponding endless path;
- said paths each including a forming portion in which die elements are to opposed to said forming surface to define a forming space therebetween;
- the forming portion of each path being configured so that one or more dimensions of the forming space reduce along the length of the forming portion to simultaneously apply lateral forces to material progressing through the forming portion to shape said material to a determined profile.

In a further aspect this invention provides a method of forming the profile of deformable materials, said method including:

- passing the material through a forming space between moving die elements;
- the die elements being configured in at least two sets, each set including a plurality of die elements respectively arranged to travel along corresponding endless paths;
- said paths each including a forming portion in which die elements of each set are opposed to define said forming space therebetween;
- the forming portion of each path being configured so that one or more dimensions of the space reduce along the length of the forming portion to simultaneously apply lateral forces to material progressing through the forming portion to shape said material to a determined profile.

In yet another aspect this invention provides a method of forming the profile of deformable materials, said method including:

- passing the material through a forming space between moving die elements and a moving forming surface;
- the die elements being configured in at least one set including a plurality of die elements arranged to travel along an endless path:
- said moving forming surface being arranged to travel about a corresponding endless path;
- said paths each including a forming portion in which die elements are opposed said forming surface to define said forming space therebetween;
- the forming portion of each path being configured so that one or more dimensions of the space reduce along the length of the forming portion to simultaneously apply lateral forces to material progressing through the forming portion of shape said material to a determined profile.

The die elements can be of any suitable shape required to form the desired profile. Where a moving forming surface is used it is preferably formed from an elastic material such as a suitable plastics or rubber material. The moving forming surface can be made up of a series of discrete blocks each corresponding to one or more die elements or an endless band.

Preferably, the dies in each set are arranged for synchronized movement with respect to the dies in the or each other set.

In a preferred form of the invention a number of sequential sets of the apparatus are used to replace the traditional roll sets in a roll forming system. Alternatively, the forming process may partially use roll sets and partly the apparatus of the present invention. The apparatus of the present invention allows the use of a lesser number of distinct forming stations, each of which provide a continuous deformation equivalent to that performed by a subset of the roll sets of the prior art process. The present invention thus provides a hybrid system having a number of distinct forming stages in which continuous forming of the profile takes place. In this regard a large amount of the design processes, for example "flower" diagrams, used in roll forming are applicable to the design of the system. The methods and apparatus of this invention represent significant improvements over conventional roll forming and will result in significantly lower levels of redundant plastic energy and residual stresses in the profile and hence less product detects. Additionally one set of the apparatus of this invention can be used in place of a number of roll sets thus reducing the overall footprint compared to the conventional roll forming approach. The apparatus of this invention additionally have less slippage between dies and material in forming direction, some products having high profile and narrow and deep groves that are difficult to be roll-formed can be produced using this method.

The apparatus of the invention also provides greater control of the material being formed particularly in controlling the stretching in forming direction. This results in the desired profile being formed without the need for straightening as is often required in prior art roll forming processes.

Another advantage of the present invention is a significant reduction in the need for initial alignment required in the prior art processes. The present invention also allows the profile tone changed without undertaking a realignment process. In accordance with the present invention the die sets can be changed, for example, by changing a chain of dies without concern about alignment. This considerably reduces downtime of the apparatus and improves productivity.

The present invention also provides for significantly simpler and improved safety arrangements. Firstly, there are less "pinch points" in the apparatus which need to be shielded against accidental access. Secondly the configuration, being compact, readily lends itself to being enclosed.

The auxiliary operations used in conventional roll forming are also applicable in the method of the present invention in a similar manner. In the case of post forming welding, for example, the present invention provides a more gentle and smooth way to enclose the gap to be welded.

In one form of the invention the forming portions of the tracks are preferably formed as a large radius curve. This results in the forming process being comparable to a roll forming process using rolls of very large radius. In accordance with the invention, each of the opposed forming portions can be formed as a large curvature radius. The radius may be the same or different depending upon the application. In some applications one of the radii may be infinite (zero curvature), that is, the path is substantially flat. The curvature centres of radii may be set on respectively opposite sides of the forming portions or may be on the same side of one of the forming portions and different radii used to achieve a convergence between the tracks in the forming portion. In other configurations, the forming portion may be made up of a variable radius. That is, the radius is not constant throughout the forming portion.

The present invention also has application to forming the profile of deformable tubular sections. In particular it is suitable for forming metal tubes of various cross section form tube with a circular cross section.

Accordingly, in yet another aspect, the present invention provides an apparatus for forming the profile of deformable tubular sections, said apparatus including:

at least two sets of die elements, each set including a plurality of die elements respectively arranged to travel along corresponding endless paths;

said paths each including a forming portion in which die elements of each set are opposed to define a forming space therebetween;

the forming portion of each said track being configured so that one or more dimensions of the space reduce along the length of the forming portion to simultaneously apply lateral forces in to a section progressing through the forming portion to shape said section to a determined profile.

In a still further aspect this invention provides a method of forming the profile of deformable tubular sections said method including passing the section through a forming space between moving die elements;

the die elements being configured in at least two sets, each set including a plurality of die elements respectively arranged to travel along corresponding endless paths;

said paths each including a forming portion in which die elements of each set are opposed to define said forming space therebetween;

the forming portion of each said path being configured so that one or more dimensions of the space reduce along the length of the forming portion to simultaneously apply lateral forces to a section progressing through the forming portion to shape said section to a determined profile.

Preferably, the dies in each set are arranged for synchronized movement with respect to the dies in the or each other set.

The paths in the forming portions can be arranged such that die elements act substantially directly opposite each other against respective sides of the tubular section or can be offset or inclined to some extent provided they substantially apply lateral forces to a section. For example three sets of die elements acting at approximately 120 degrees to each other could be used. In a preferred form of the invention four sets of die elements are used to form two substantially directly opposed pairs in the forming region.

The forming region of the apparatus is preferably relatively long compared to the deformation required to achieve the determined profile. Typically the forming portion can be of the order of 1.5 to 2 meters long.

The dies can be of any desired shape. In one form of the invention flat dies are used in opposed pairs to form a rectangular hollow section. Alternatively, the dies can be respectively concave, convex, male or female in various configurations to provide the desired determined side profile. For example, opposed female and male die profiles may be used to produce a profile with a longitudinally extending groove on one surface. A pair of convex dies could be used to provide an elliptical profile. Other configurations of dies can be used to produce a wide variety of profiles.

In one preferred form of the apparatus the sets of dies are driven substantially at the same rate. However, a use of appropriate dies and adjusting the phase of movement of the respective sets of dies can be used to control the deformation of the material to be formed in order to get a better quality of product.

The die elements in one form of the invention are arranged in the form of an endless chain with each die element forming or attached to a link connected to the adjacent links. In other configurations the die elements may be fitted to an appropriate track so as to move around the predetermined endless path. In this configuration the individual die elements may or may not be interconnected.

In accordance with the invention the pitch between each die in the forming portion of the track is small compared to the radius of the track. Preferably, the pitch-radius ratio is over 1:500. That is the maximum gap between the adjacent dies is only 1/500th of the height or even smaller. The pitch height is also proportional to the pitch-radius ratio of the pitch.

The die elements can be driven so as to draw a section to be formed through the forming portion. In the case of die elements configured in a chain arrangement this can be achieved by drive sprockets operating on the chain. In an alternative, separate driving rolls or other suitable mechanisms can be employed to either drive the sections through the apparatus or pull the section through the apparatus.

In one form of the invention the apparatus produces a tubular section of constant profile in a continuous process. In another form of the invention the profile of the sets of dies corresponds to a section having a varying profile. This is a batch process in which lengths of the section having for example tapered profile or formed with ribs or grooves or even profiles varying in shape along the length of the section can be produced.

Embodiments of the invention will now be described, by way of example only with reference to the accompanying drawings.

BRIEF DESCRIPTION OF THE DRAWINGS

FIG. 3(*b*) is a schematic elevation of part of the apparatus shown in FIG. 3(*a*);

FIGS. 4(*b*) and 4(*c*) schematically illustrates a configuration of dies suitable for use in the embodiment of FIG. 3;

BEST MODES FOR CARRYING OUT THE INVENTION

Figure 1:
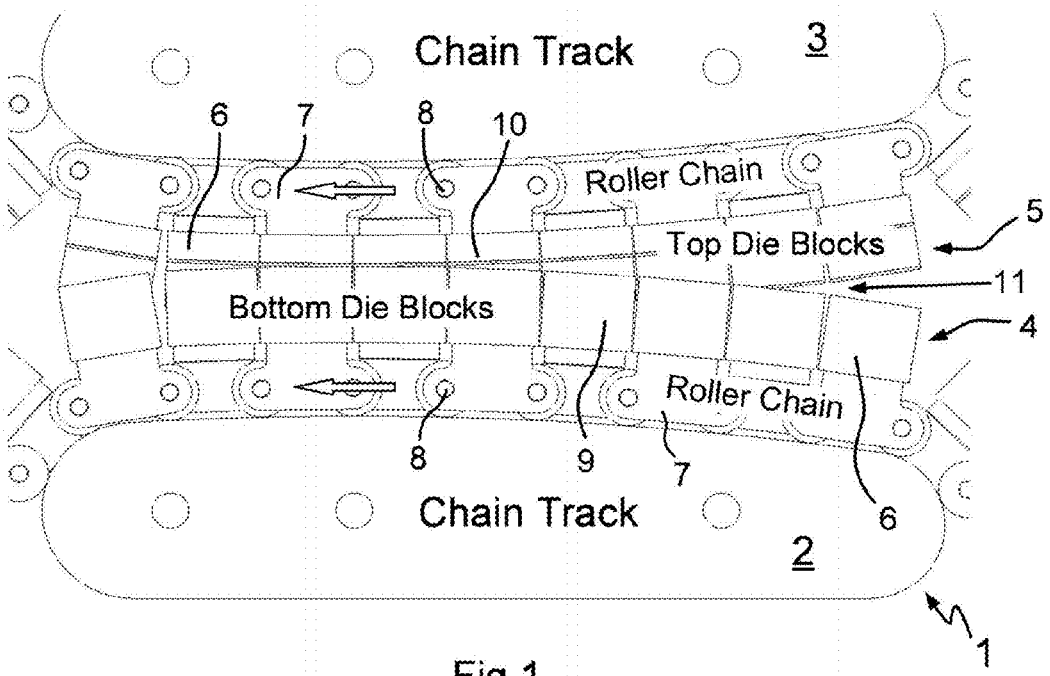
FIG. 1 is a schematic elevation of an apparatus for forming the profile of deformable sheet material according to an embodiment of the invention.
Figure 2:
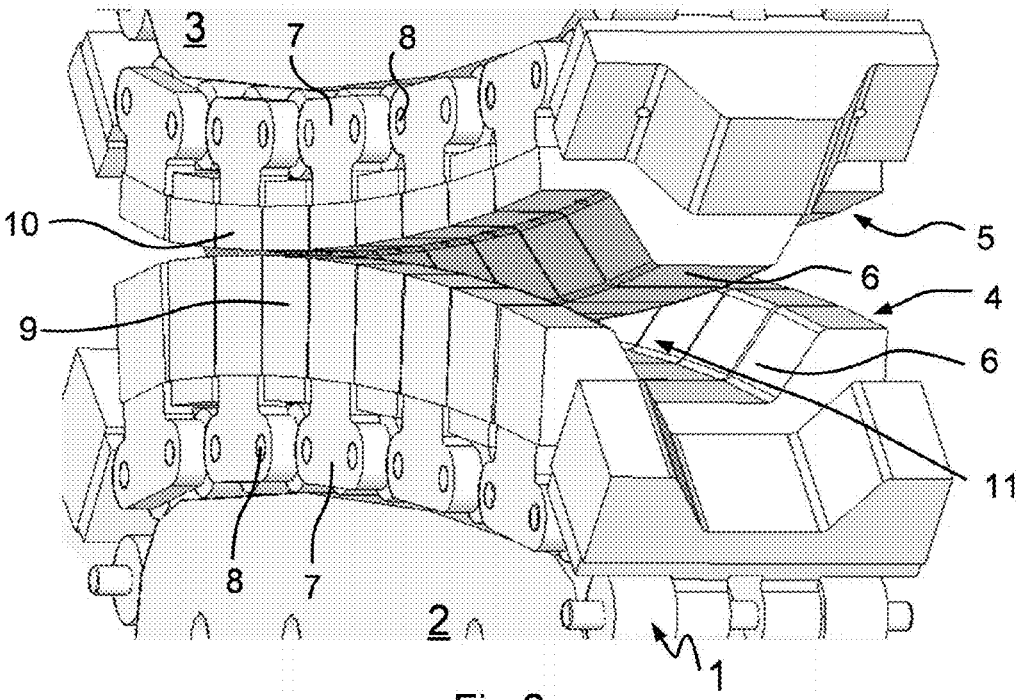
FIG. 2 is a schematic perspective view of the apparatus shown in FIG. 1.

Referring to the FIGS. 1 and 2 a schematic configuration of the apparatus for forming the profile of deformable sheet material is shown. The apparatus 1 includes two track frames 2, 3 that mount respective sets 4, 5 of die elements 6. The die elements 6 have any suitable profile determined by the profile desired to be formed. In the illustrated embodiment respective male and female die sets suitable for forming a channel or a top-hat profile are shown. Each die element 6 is mounted on a chain link 7 respectively connected to the adjacent chain link 7 by a pin 8 in a conventional manner to form a roller chain. The track frames 2, 3 define respective endless paths or tracks around which the links 7 travel. Each of the paths has a forming portion 9, 10 in which the die elements 6 of each set are opposed to define a forming space 11. Other than in the forming portion, it is not necessary for the chain links 7 to contact the track frame. The forming portions 9, 10 are configured so that the dimensions of the space 11 between the forming portions reduce along its length. In this way transverse forces are simultaneously applied to a section passing through the forming portion. The die elements 6 move with the material synchronisely and the distance between the sets of elements 6 gradually reduces.

Figure 3A:
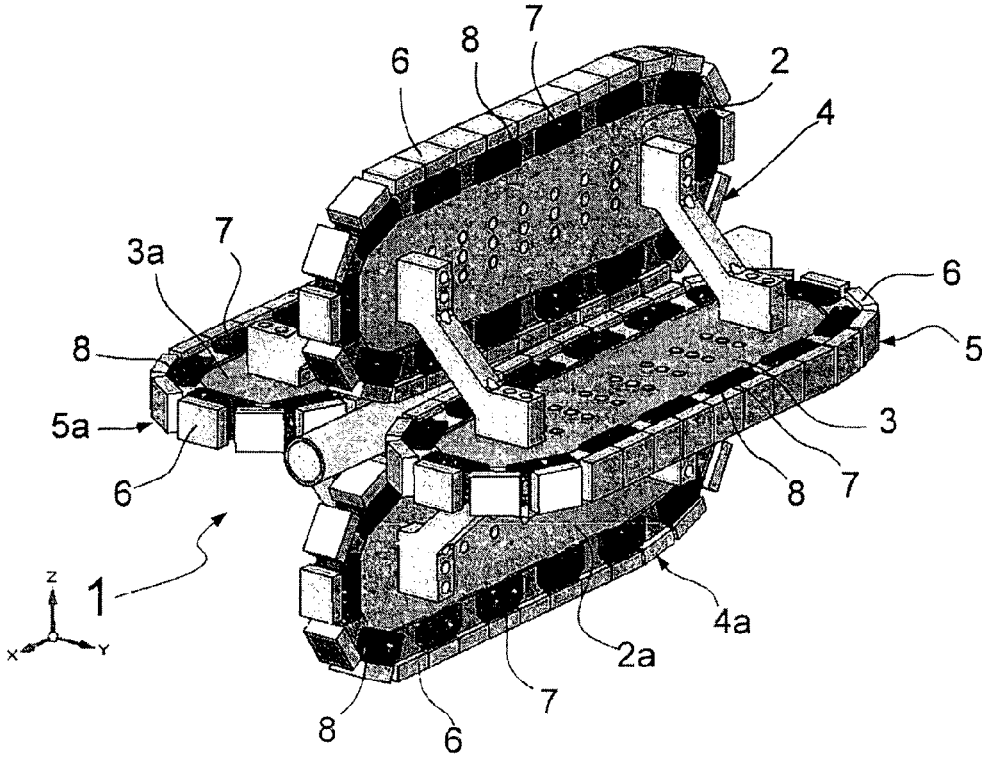
FIG. 3(*a*) is a schematic perspective view of an apparatus for forming the profile of deformable tubular sections according to an embodiment of the invention.
Figure 3B:
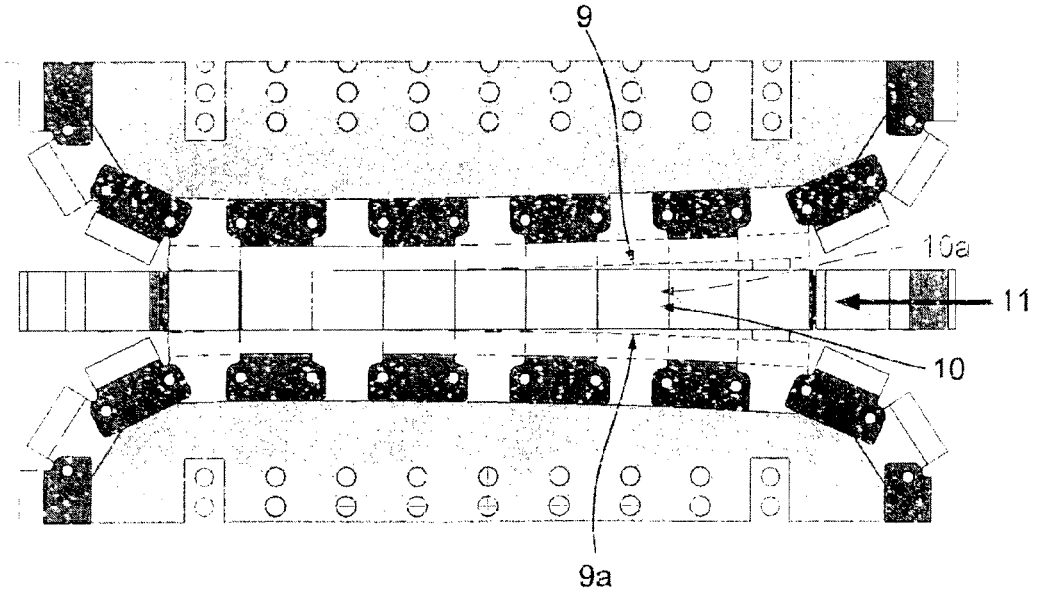

FIG. 3 shows an embodiment of the invention for forming the profile of a deformable hollow section from a pre-formed tubular section. The same reference numerals as used in relation to FIGS. 1 and 2 have been used to identify corresponding integers. The apparatus 1 includes four track frame elements 2, 2*a*, 3, 3*a* arranged in opposed pairs. Each track frame element mounts respective sets 4, 4*a*, 5, 5*a* of die elements 6. The die elements 6 have any suitable profile determined by the profile desired to be formed in the material. Each die element 6 is mounted on a chain link 7 respectively connected to the adjacent chain link 7 by a pin 8 in a conventional manner to form a roller chain. The track frames 2, 2*a*, 3, 3*a* define respective endless paths around which the links 7 travel. Each of the paths has a forming portion 9, 9*a*, 10, 10*a* in which the die elements 6 associated with each pail of track frames are opposed to define a forming space 11. The forming portions 9, 9*a*, 10, 10*a* are configured so that the dimensions of the space 11 between the forming portions reduce along its length. In this way transverse forces are simultaneously applied to a section passing through the forming portion. This can be visualised as the section to be formed being forced through a progressively smaller aperture as it progresses through the forming portion.

Figure 4:
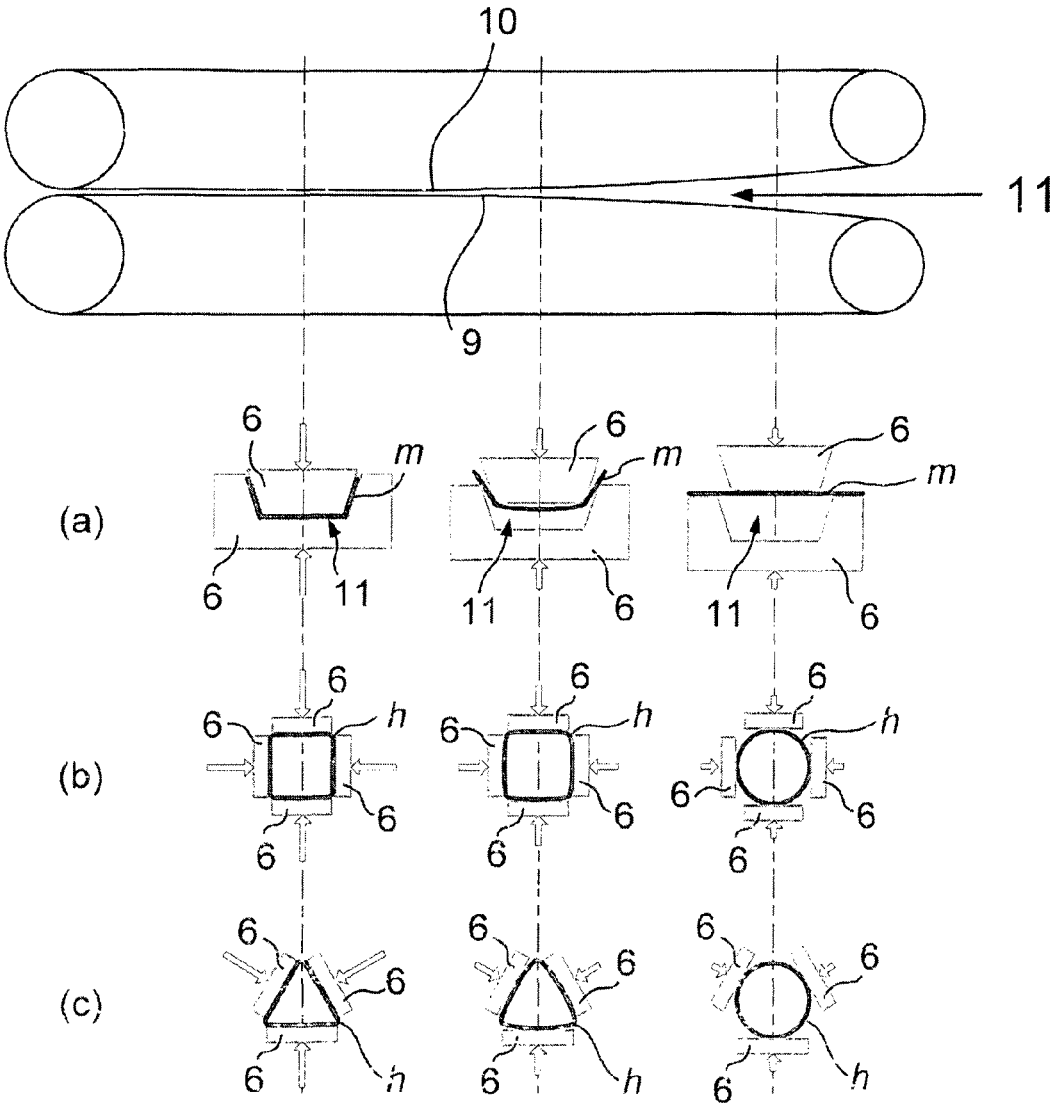
FIG. 4(*a*) schematically illustrates a configuration of dies suitable for use in the embodiment of FIGS. 1 and 2.

FIGS. 4(*a*) to 4(*c*) show three different configurations of die elements 6 profiles at respective locations along the formed portion 10. FIG. 4(*a*) shows a configuration applicable to the embodiment shown in FIGS. 1 and 2 for forming the profile of a deformable sheet material m. The die sets are made up of respective male and female opposed dies. As the dies move along the forming portions 9, 10 the distance between them decreases to reduce the forming space in the direction from right to left. This progressively forms the material to a desired profile.

FIGS. 4(*b*) and 4(*c*) show a configuration of die sets used in the embodiment generally described in relation to FIG. 3. In FIG. 4(*b*) four die sets arranged in opposed pairs are used to form a circular section h into a square section as the dies move together along the forming space. FIG. 4(*c*) shows an arrangement in which three sets of dies displaced at 120° to form a circular section h to a triangular profile.

Figure 5:
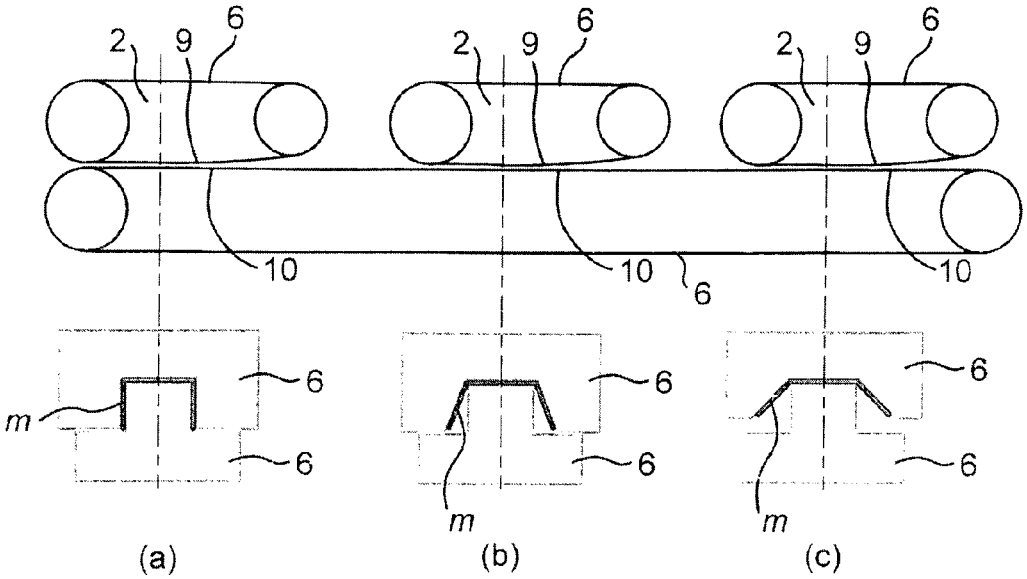
FIGS. 5(*a*) to 5(*c*) schematically illustrate a modification to the embodiment of FIGS. 1 and 2, FIGS. 6(*a*) to 6(*c*) schematically show different driving mechanisms applicable to the embodiments of both FIGS. 1 and 2 and FIG. 3.

FIG. 5 shows an alternative to the apparatus shown in FIGS. 1 and 2. In this configuration one lower set 12 of die elements 6 have the profile of the final die profile. Three upper sets 6 of progressive shaped complimentary die elements upon track frames 2 are sequentially positioned. In the same manner as described in relation to FIGS. 1 and 2 this provides forming portions 9, 10 at three spaced apart locations. In the same way as described above the forming portions of the tracks are configured to progressively reduce the dimensions to the space 11 between the dies. The material m to be formed progressively proceeds from right to left as shown in the drawings and is formed to the desired profile by the sequential operation of the die sets.

Figure 6:
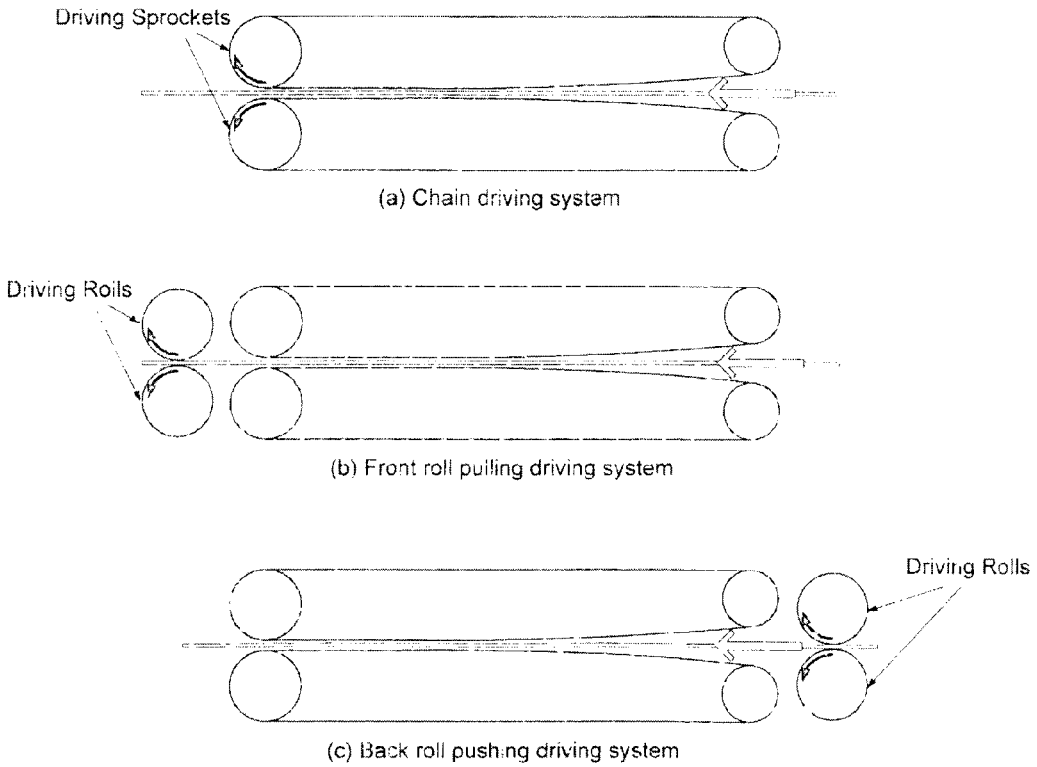

FIGS. 6(*a*) to 6(*c*) show souse exemplary ways in which the apparatus can operate. In FIG. 6(*a*) the system is provided with driving sprockets which drive the two sets of die elements in phase so as to draw a section through the forming portion. In FIG. 6(*b*) separate set of driving rolls is provided to propel this section through the forming portion. FIG. 6(*c*) shows a similar configuration in which a separate set of driving rolls are used to push a section through the forming portion.

Figure 7:
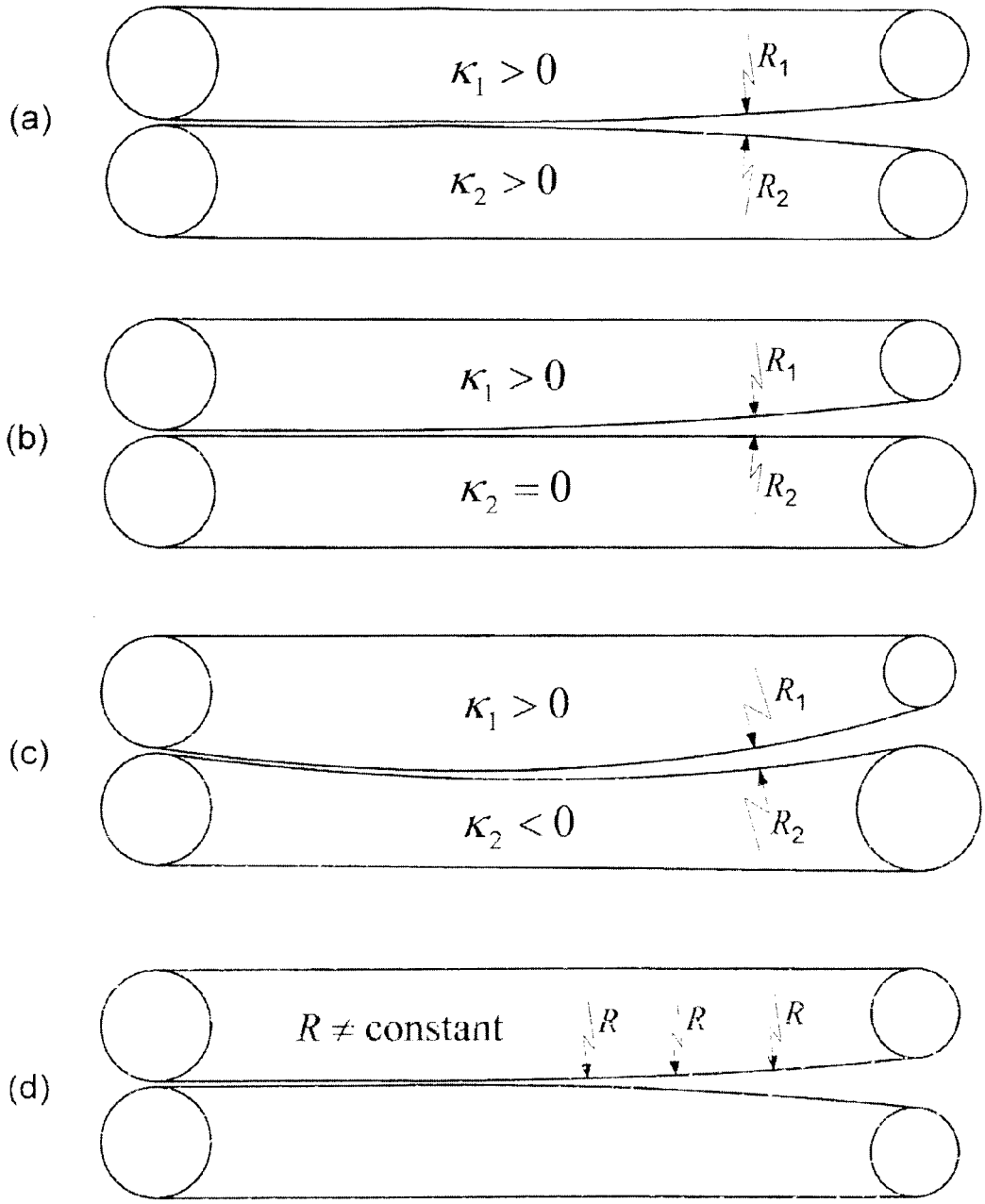
FIGS. 7(*a*) to 7(*d*) schematically show track configurations applicable to the embodiments of both FIGS. 1 and 2 and FIG. 3.

FIGS. 7(*a*) to 7(*d*) show some of the possible configurations of the track in the forming portion of the apparatus. In FIG. 7(*a*) each of the opposed forming portions has a large radius and the centre of the radii are respectively on the opposite sides of the forming space. FIG. 7(*b*) shows configuration in which one of the forming portions has a large radius and another has an infinite radius or in other words is flat. FIG. 7(*c*) shows a configuration in which the centres of the radii are both on one side of the forming, space and large radii are used for the respective forming portions to provide converging paths between the opposed dies. FIG. 7(*d*) shows a configuration in which the radii of the forming portion is not constant to provide a converging track between the opposed dies.

Figure 8:
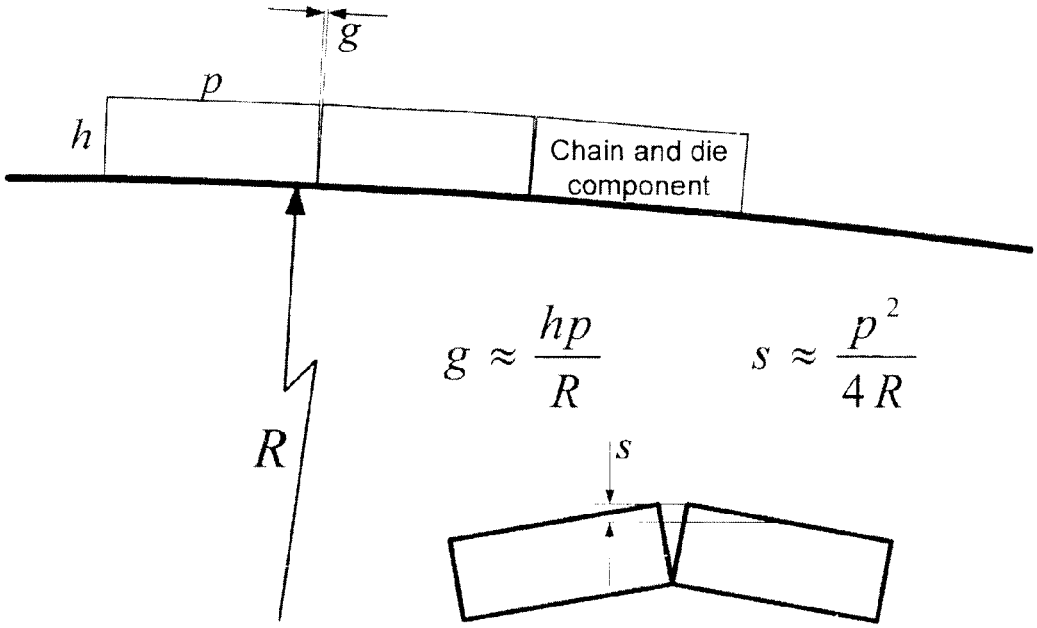
FIG. 8 schematically shows the relationship between maximum gap between adjacent dies and the radius of the forming portion of the track applicable to the embodiments of both FIGS. 1 and 2 and FIG. 3.

FIG. 8(*a*) schematically shows the relationship between the maximum gap between adjacent dies on the chain and the radius of the portion of the track. In accordance with the invention the pitch to radius ratio is large and preferably over 1:500. As shown in the diagram the maximum gap between the adjacent dies is approximately the product of the height and the length divided by the radius of the track. The distance s the chord height between cord c extending through the mid point of the upper die surface and the adjacent die corners is a measure of the relative angle between the die blocks. It is approximately equal to the square of the length of each die divided by quad the radius. It will be apparent that larger gaps may occur in portions of the track other than the forming portion without in any way affecting the operation of the apparatus.

Figure 9:
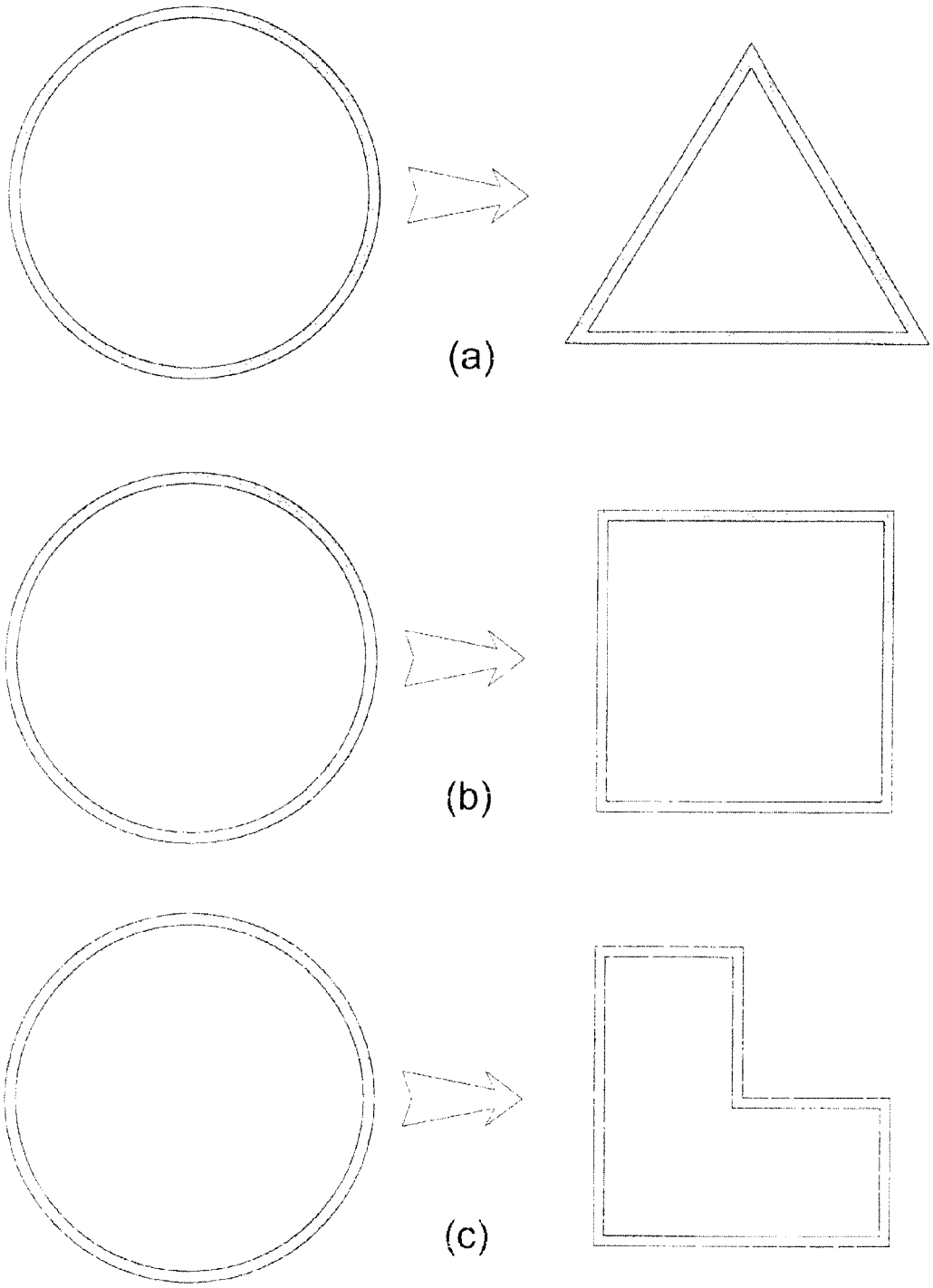
FIGS. 9(*a*) to 9(*c*) shows some of the profiles that can be formed from a circular section using the embodiment of FIG. 3.

FIGS. 9(*a*) to 9(*c*) schematically shows some of the profiles that can be formed from a circular section using the apparatus of this invention. FIG. 9(*a*) shows a triangular profile. FIG. 9(*b*) shows a rectangular profile and FIG. 9(*c*) a stepped profile. It will be apparent however that appropriate selection of die shapes can produce a wide range of profiles.

Figure 10:
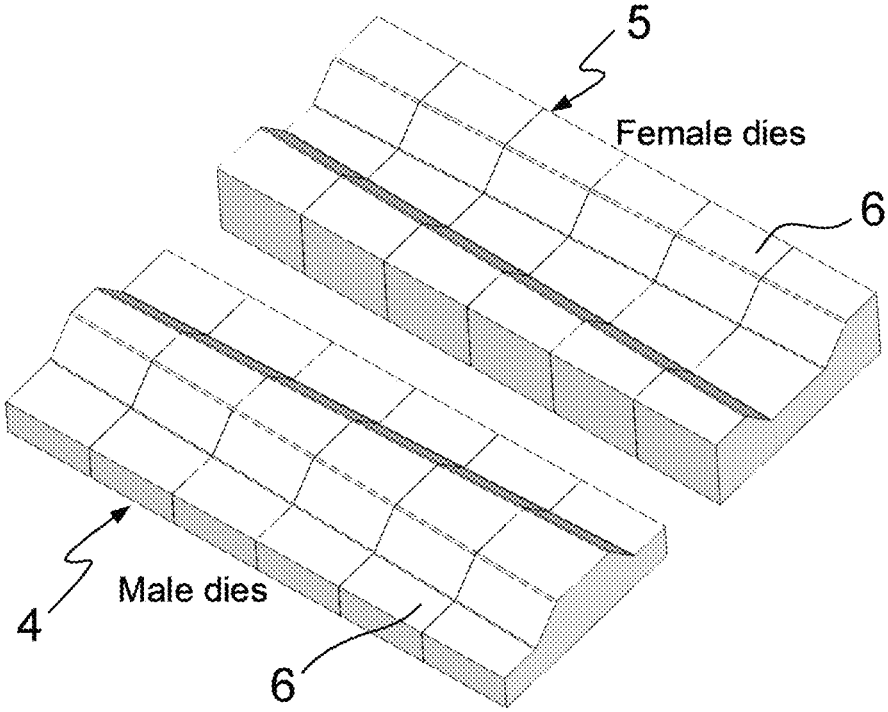
FIG. 10 schematically shows a set of dies used in a extensive application of the apparatus of FIGS. 1 and 2.

FIG. 10 shows a modified form of the die sets suitable for use in the invention as described in FIGS. 1 and 2. As shown in the drawings the die elements 6 are not uniform but form a taper. By arranging these dies in sections on corresponding parts of the respective tracks a profile having a longitudinal taper or other desired non linear form can be formed.

Embodiments of this invention can be in the form of standalone equipment lined before or after a forming process such as roll forming to process auxiliary operations such as blanking, punching, doming, coining, shearing and the like. Because the forming dies' velocity is so close to the strip's velocity, the auxiliary operation is processed continuously without the interference with the strip that occurs in the rotary punching or doming.

Figure 11A:
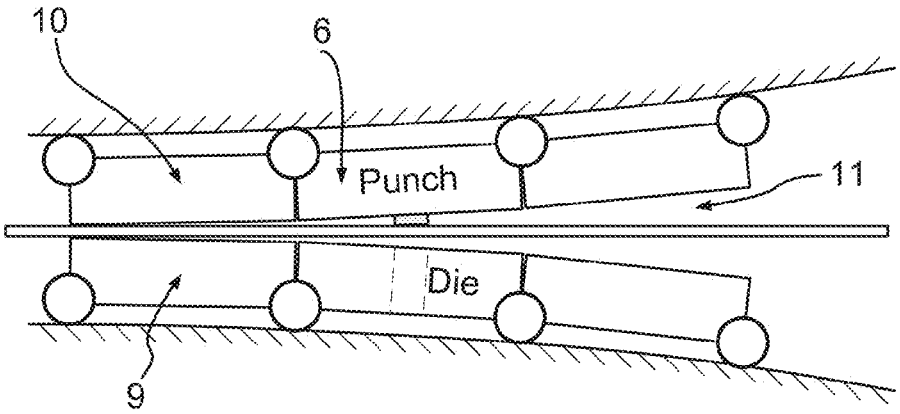
Figure 11B:
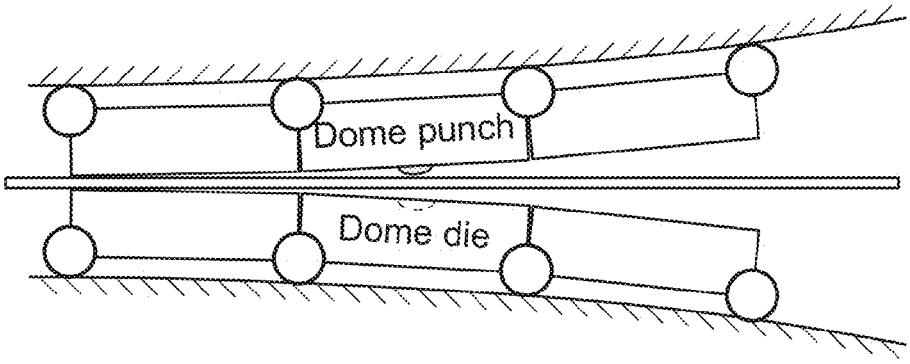

FIGS. 11 (*a*) and 11 (*b*) schematically show die configurations for performing punching and doming respectively. As in the other embodiments opposed dies corresponding shaped to perform the operation more through a forming function in which the dimension of the forming space reduce along the length of the forming portion.

In the embodiments discussed above, one part of the die elements (for example, male die elements), are rigid to ensure the profile to be formed but the another can be elastically deformable such as using polyurethane. The deformable die elements can provide adequate compressing force to the material to be formed and/or compensate the variation of material properties and thickness.

Figure 12:
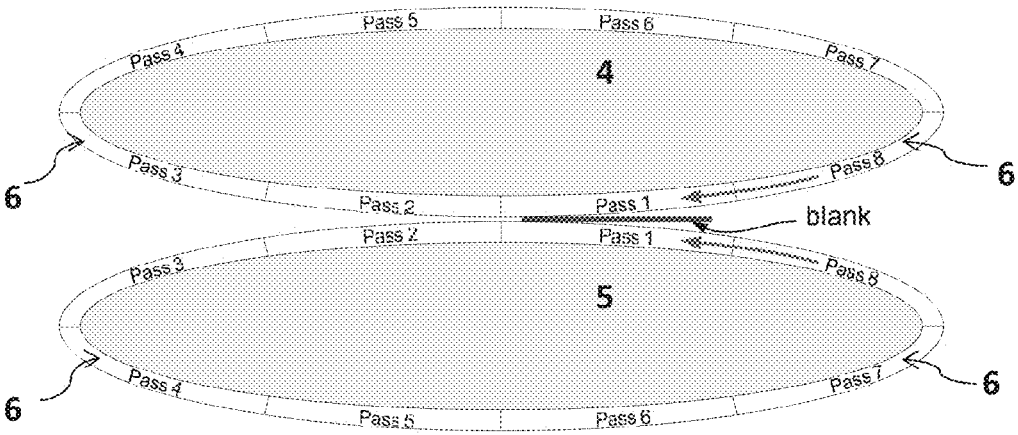

Embodiments of the invention can also be used to form a part having limited length that requires multiple passes to form. As schematically shown in FIG. 12 the forming dies for each pass (for example, 8 passes as shown) are arranged in one set and the motions of the sets are synchronised. The blank is fed into the former a corresponding number of times to achieve the final profile in one machine. One advantage of this arrangement is to save the capital and space, and another is this type former can be placed beside an assembly line for multi component product and after forming a workpart on-site, the part can be assembled to the product directly.

In the embodiment discussed, a guiding system can be a separate apparatus or embedded in the die-blocks. In order to avoid the sheet metal slip sideway, using magnetic die blocks in one die set can sufficiently control the steel strip moving straight forward. Other method such as guide plates assembled on the die-blocks may also be applied to guide the strip going straight.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The foregoing describes only some embodiments and modifications can be made without departing from the scope of the invention.

The invention claimed is:

1. An apparatus for forming the profile of deformable materials, said apparatus comprising:

at least two sets of die elements arranged for synchronized movement with respect to each other, each set including a plurality of die elements respectively arranged to travel along corresponding endless paths;

said paths each including a forming portion in which die elements of each set are opposed to define a forming space therebetween; and the forming portion of each path being configured so that one or more dimensions of the forming space reduce along a length of the forming portion to simultaneously apply lateral forces to material progressing through the forming portion to shape said material to a determined profile and so that at least one of the forming portions of the paths is formed as a large radius curve, wherein a ratio of a pitch between each die in the forming portion of the path and the radius of the path is over 1:500, and wherein each die element has a base and a forming surface spaced from the base, the dies being configured so that any section taken perpendicular to the base of the die has along the longitudinal axis a constant depth from the base to the longitudinal axis and a constant depth from the forming surface to the longitudinal axis so that in each respective section the depth is the same along the forming surface of the die element, such that each of the opposing die elements define flat, planar forming surfaces.

2. The apparatus according to claim 1, wherein each of the opposed forming portions are formed as a large curvature radius.

3. The apparatus according to claim 2, wherein curvature centres of radii of the opposed forming portions are on respectively opposite sides of the corresponding forming portions.

4. The apparatus according to claim 2, wherein respective curvature centres of radii of the opposed forming portions are on a same side of the forming portions.

5. The apparatus according to claim 1, wherein the radius of at least one large radius curve is variable over the forming portion.

6. The apparatus of claim 1, wherein the die elements are arranged in a form of an endless chain with each die element forming or attached to a link connected to one or more adjacent links.

7. An apparatus for forming the profile of deformable materials, said apparatus comprising:

at least one set of die elements including a plurality of die elements arranged to travel along an endless path;

a moving forming surface arranged to travel about a corresponding endless path, the dies and the forming surface being arranged for synchronized movement with respect to each other;

said paths each including a forming portion in which die elements are to opposed to said forming surface to define a forming space therebetween;

the forming portion of each path being configured so that one or more dimensions of the forming space reduce along a length of the forming portion to simultaneously apply lateral forces to material progressing through the forming portion to shape said material to a determined profile and so that at least one of the forming portions of the paths is formed as a large radius curve, wherein a ratio of a pitch between each die in the forming portion of the path and the radius of the path is over 1:500, and wherein each die element has a base and a forming surface spaced from the base, the dies being configured so that any section taken perpendicular to the base of the die has along the longitudinal axis a constant depth from the base to the longitudinal axis and a constant depth from the forming surface to the longitudinal axis so that in each respective section the depth is the same along the forming surface of the die element, such that each of the opposing die elements define flat, planar forming surfaces.

8. A method of forming the profile of deformable materials, said method comprising:

passing the material through a forming space between moving die elements;

the die elements being configured in at least two sets, each set including a plurality of die elements respectively arranged to travel along corresponding endless paths;

said paths each including a forming portion in which die elements of each set are opposed to define said forming space therebetween;

the forming portion of each path being configured so that one or more dimensions of the space reduce along a length of the forming portion to simultaneously apply lateral forces to material progressing through the forming portion to shape said material to a determined profile, wherein each of the opposed forming portions are formed as a large radius curve and a ratio of a pitch between each die in the forming portion of the path and the radius of the path is over 1:500, and wherein each die element has a base and a forming surface spaced from the base, the dies being configured so that any section taken perpendicular to the base of the die has along a longitudinal axis a constant depth from the base to the longitudinal axis and a constant depth from the forming surface to the longitudinal axis so that in each respective section the depth is the same along the forming surface of the die element, such that each of the opposing die elements define flat, planar forming surfaces.

9. The method according to claim 8, wherein curvature centres of radii of each of the large radius curves are on respectively opposite sides of the corresponding forming portions.

10. The method according to claim 8, wherein the respective curvature centres of radii are on a same side of the forming portions.

11. The method according to claim 8, wherein at least one of the radii of the large radius curves is variable over the forming portion.

12. The apparatus according to claim 1, wherein the deformable material is a tubular section.

13. The apparatus of claim 12, wherein the forming portions are arranged such that the die elements of the at least two sets act substantially directly opposite each other against respective sides of the tubular section.

14. The apparatus of claim 13, further comprising four sets of die elements arranged to form two substantially directly opposed pairs in the forming portion.

15. The method of claim 8, wherein the deformable material is a tubular section.

16. The method of claim 15, wherein there are four sets of die elements arranged to form two substantially directly opposed pairs in the forming portion.

17. An apparatus according to claim 7, comprising three sets of die elements, the die elements configured to cooperate with the moving forming surface to progressively form the deformable material into the determined profile.

18. An apparatus for forming the profile of deformable materials, said apparatus comprising:

at least two sets of die elements arranged for synchronized movement with respect to each other, each set including a plurality of die elements respectively arranged to travel along corresponding endless paths;

said paths each including a forming portion in which die elements of each set are opposed to define a forming space therebetween; and the forming portion of each path being configured so that one or more dimensions of the forming space reduce along a length of the forming portion to simultaneously apply lateral forces to material progressing through the forming portion to shape said material to a determined profile and so that at least one of the forming portions of the paths is formed as a large radius curve, wherein a ratio of a pitch between each die in the forming portion of the path and the radius of the path is over 1:500, wherein the dies of each set are arranged in synchronised sections of opposing dies, the dies in each section having a non-uniform profile and cooperating to progressively form a determined profile having a longitudinal taper, and wherein each die element has a base and a forming surface spaced from the base, the dies being configured so that any section taken perpendicular to the base of the die has along a longitudinal axis a constant depth from the base to the longitudinal axis and a constant depth from the forming surface to the longitudinal axis so that in each respective section the depth is the same along the forming surface of the die element, such that each of the opposing die elements define flat, planar forming surfaces.

* * * * *